US007063508B2

(12) United States Patent
Higashimori et al.

(10) Patent No.: US 7,063,508 B2
(45) Date of Patent: Jun. 20, 2006

(54) TURBINE ROTOR BLADE

(75) Inventors: Hirotaka Higashimori, Nagasaki (JP); Katsuyuki Osako, Nagasaki (JP); Takashi Shiraishi, Kanagawa (JP); Takashi Mikogami, Kanagawa (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/424,729

(22) Filed: Apr. 29, 2003

(65) Prior Publication Data

US 2003/0228226 A1 Dec. 11, 2003

(30) Foreign Application Priority Data

Jun. 7, 2002 (JP) ..... 2002-167688

(51) Int. Cl.
*F01D 5/14* (2006.01)

(52) U.S. Cl. ..... 416/185; 416/223 R

(58) Field of Classification Search ..... 416/97 R, 416/97 A, 96 R, 96 A, 95, 185
See application file for complete search history.

(56) References Cited

U.S. PATENT DOCUMENTS

| | | | | |
|---|---|---|---|---|
| 4,080,102 | A | 3/1978 | Schwab | |
| 4,229,140 | A * | 10/1980 | Scott | 416/97 R |
| 4,303,374 | A * | 12/1981 | Braddy | 416/97 R |
| 4,314,442 | A * | 2/1982 | Rice | 60/775 |
| 4,545,197 | A * | 10/1985 | Rice | 60/775 |
| 5,690,473 | A * | 11/1997 | Kercher | 416/87 A |
| 6,102,658 | A * | 8/2000 | Kvasnak et al. | 416/97 R |
| 6,422,821 | B1 * | 7/2002 | Lee et al. | 416/224 |
| 2001/0007634 | A1 | 7/2001 | Beyer | |
| 2004/0105756 | A1 | 6/2004 | Higashimori et al. | |
| 2004/0115044 | A1 | 6/2004 | Osako et al. | |

FOREIGN PATENT DOCUMENTS

| | | |
|---|---|---|
| DE | 1 296 875 | 6/1969 |
| JP | 56-12681 | 3/1981 |
| JP | 6012201 A * | 6/1985 |
| JP | 2-16302 | 1/1990 |
| JP | 6-47601 | 6/1994 |
| JP | 2599250 | 7/1999 |
| JP | 2599250 Y2 * | 7/1999 |

* cited by examiner

*Primary Examiner*—Edward K. Look
*Assistant Examiner*—Richard A. Edgar
(74) *Attorney, Agent, or Firm*—Oblon, Spivak, McClelland, Maier & Neustadt, P.C.

(57) ABSTRACT

A trailing edge of a turbine rotor blade is formed so that a deflection angle of a blade surface in a downstream side of a maximum blade thickness portion is a predetermined value or less, by forming the trailing edge of the rotor blade so as to be inclined from a center line of a blade thickness toward an extension line of a suction surface. Since the trailing edge of the rotor blade is thus formed, a rapid increase of the deflection angle is prevented in a trailing edge portion of the rotor blade. Accordingly, a rapid ascent portion and a rapid deceleration portion are not generated in a suction surface velocity in a main stream unlike the conventional case.

7 Claims, 6 Drawing Sheets

TURBINE ROTOR BLADE

BACKGROUND OF THE INVENTION

1) Field of the Invention

The present invention relates to a turbine rotor blade that can prevent flow separation in a trailing edge portion of the rotor blade and can prevent a loss of flow from being increased.

2) Description of the Related Art

FIG. 7 and FIG. 8 are cross sectional views of a conventional turbine rotor blade, FIGS. 9A and 9B are cross sectional views of the rotor blade shown in FIG. 7 or FIG. 8 in a cross section along a line D—D, and FIG. 10A is a schematic view of a conventional blade surface velocity and FIG. 10B is a schematic view of a separation state of the flow based on a blade shape. FIG. 7 shows a case that a trailing edge of the rotor blade is formed in a parabolic shape, and this case is disclosed by the applicant of the present invention in Japanese Utility Model No. 2599250. Further, FIG. 8 shows a case that the trailing edge of the rotor blade is formed in a linear shape.

As shown in FIG. 7 to FIG. 9A and FIG. 9B, a plurality of rotor blades 2 provided radially in a circumferential direction of a boss 1 are formed so that a blade thickness t becomes gradually thinner toward a trailing edge 3 of the rotor blade. Since the thickness t of a part just before being thin is generally set to a maximum blade thickness in many cases, this part is called a maximum blade thickness portion and a downstream side of the maximum blade thickness portion 4 is called a trailing edge portion 5, for convenience in explanation.

There are assumed an extension line 6*a* of a suction surface 6 in an upstream side of the maximum blade thickness portion 4, an extension line 7*a* of a pressure surface 7 in the upstream side of the maximum blade thickness portion 4, and a center line 8 of the blade thickness t. At this time, the trailing edge 3 of the trailing edge portion 5 based on the conventional technology is designed to be positioned on the center line 8.

A cross section near the trailing edge portion 5 is formed in the manner mentioned above because the blade shape is conventionally planned based on the center line 8, and the blade thickness t is set in such a manner that the blade thickness t is divided into the suction surface 6 and the pressure surface 7 by one half in a perpendicular direction with respect to the center line 8.

However, in the conventional turbine rotor blade, the trailing edge 3 is formed in the manner mentioned above, and therefore a suction surface velocity 9 in a main stream generates a rapid ascent portion 11 due to a rapid increase of a deflection angle θ of flow in the downstream side of the maximum blade thickness portion 4, and generates a rapid deceleration portion 12 running into the trailing edge 3, as shown in FIG. 10A and FIG. 10B. Accordingly, there has been a problem that a separation portion 13 of the flow occurs in the trailing edge portion 5 of the suction surface 6, and a loss of flow is increased.

SUMMARY OF THE INVENTION

It is an object of the present invention to solve at least the problems in the conventional technology.

The turbine rotor blade according to an aspect of this invention includes a first portion having a first suction surface and a first pressure surface; a second portion adjoining the first portion, having a second suction surface and a second pressure surface that are contiguous to the first suction surface and the first pressure surface, respectively; a leading edge that is arranged in the first portion, and from which an inlet flow enters into the turbine rotor blade from a substantially radial direction of the radial turbine rotor blade or from a direction between a radial direction and an axial direction of the mixed flow turbine rotor blade; a trailing edge at which the second suction surface and the second pressure surface of the second portion intersect with each other, and from which the flow is blown out in a substantially tangential direction of the turbine rotor blade; a root end configured to be fixed to a hub; and a tip end opposite to the root end, wherein the root end and the tip end define a height of the turbine rotor blade therebetween, wherein: the turbine rotor blade has a maximum thickness in the first portion adjacent to a boundary between the first portion and the second portion; when viewed along a cross section in a plane perpendicular to a height direction of the turbine rotor blade over at least a part of the height of the turbine rotor blade, an imaginary plane that passes at a half of a distance between the first suction surface and the first pressure surface corresponds to a center line, the first suction surface corresponds to a suction surface line, and the trailing edge is arranged between an imaginary center line extended from a center line and an imaginary extension line extended from the suction surface line; the tip end includes a first tip end at a side where the leading edge exists and a second tip end at a side where the trailing edge exists; and a distance between an axis of the turbine rotor and an intersection of the first tip end and the leading edge is longer than a distance between the axis and the second tip so that the turbine rotor blade deflects the inlet flow toward the axial direction of the turbine rotor blade on a meridian section, and the flow is blown out at the trailing edge toward the substantially tangential direction of the turbine rotor blade.

The other objects, features and advantages of the present invention are specifically set forth in or will become apparent from the following detailed descriptions of the invention when read in conjunction with the accompanying drawings.

DETAILED DESCRIPTION

Exemplary embodiments of the turbine rotor blade according to this invention will be explained in detail with reference to the accompanying drawings. The present invention is not limited by the embodiments.

Figure 1A:
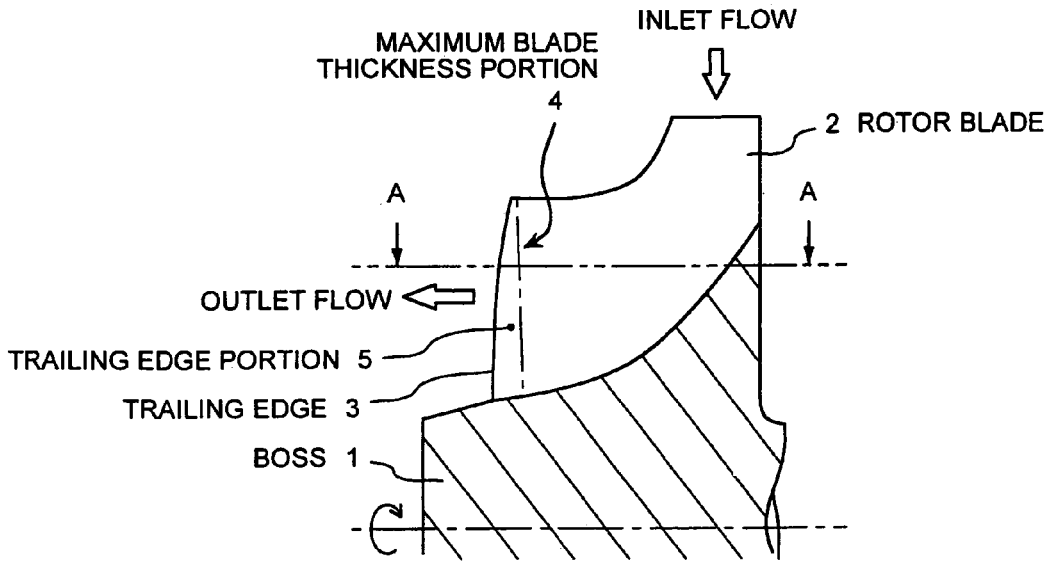
FIG. 1A is a cross sectional view of a turbine rotor blade according to a first embodiment of this invention.
Figure 1C:
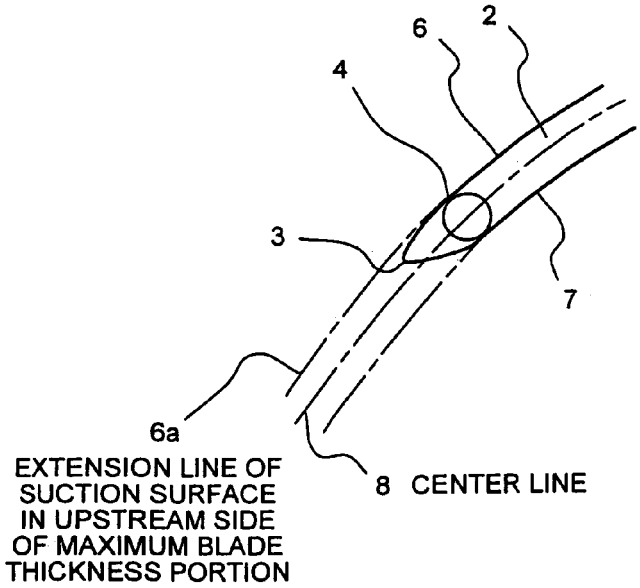
FIG. 1C is a magnified view of a portion indicated in a circle in FIG. 1B.
Figure 1B:
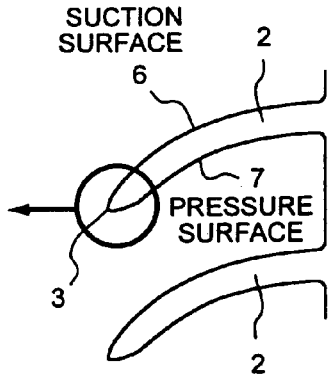
FIG. 1B is a cross sectional view of the turbine rotor blade along a line A—A in FIG. 1A.
Figure 2:
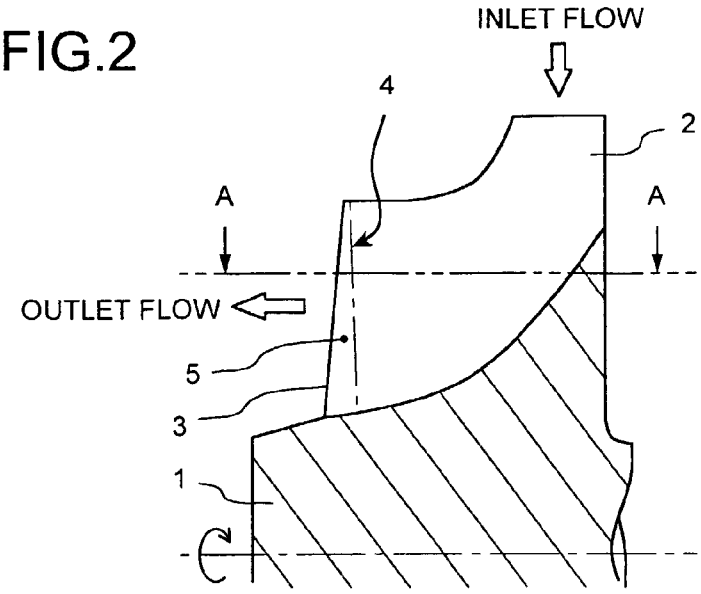
FIG. 2 is a cross sectional view of a turbine rotor blade whose trailing edge is formed in a linear shape.
Figure 3A:
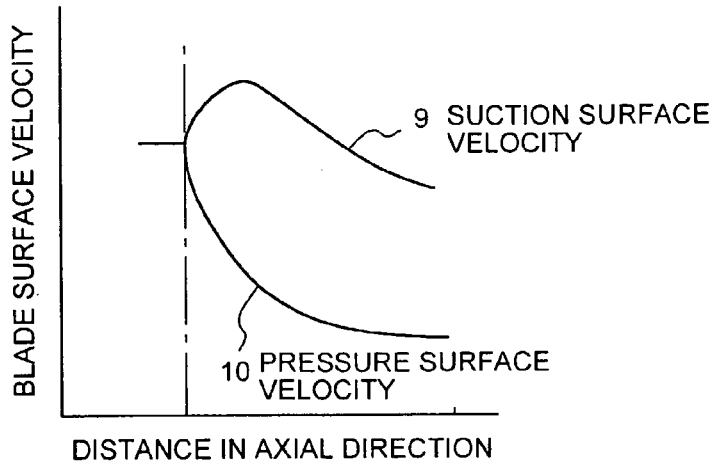
FIG. 3A is a schematic view of a blade surface velocity.
Figure 3B:
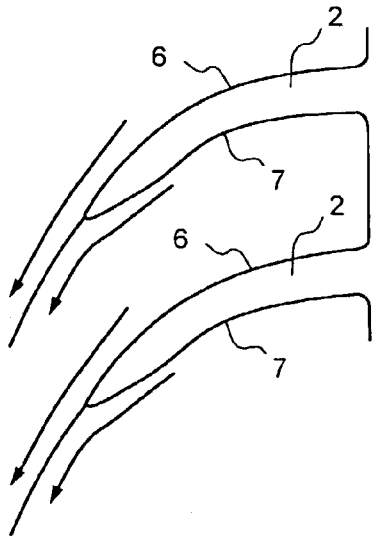
FIG. 3B is a schematic view of a state of flow.

FIG. 1A is a cross sectional view of a turbine rotor blade according to a first embodiment of this invention, and FIG. 1B is a cross sectional view of the turbine rotor blade along a line A—A in FIG. 1A, and FIG. 1C is a magnified view of a portion indicated in a circle in FIG. 1B. The first embodiment is an embodiment applied to a rotor blade whose trailing edge is formed in a parabolic shape. FIG. 2 is a cross sectional view of a turbine rotor blade whose trailing edge is formed in a linear shape. FIG. 3A is a schematic view of a blade surface velocity, and FIG. 3B is a schematic view of a state of flow. In this case, in the following description, the same reference numerals are attached to the same members as the already described members or the corresponding members, and an overlapping explanation will be omitted or simplified.

As shown in FIGS. 1A, 1B and 1C, the trailing edge 3 of the rotor blade 2 is formed so as to be inclined from the center line 8 of the blade thickness toward the extension line 6*a* of the suction surface 6 in an upstream side of the maximum blade thickness portion 4, and thereby the trailing edge 3 is formed so that a deflection angle of a blade surface in a downstream side of the maximum blade thickness portion 4 becomes small. In this case, the rotor blade 2 whose trailing edge 3 is formed in a linear shape (refer to FIG. 2) can be formed in the same manner as mentioned above.

Figure 10A:
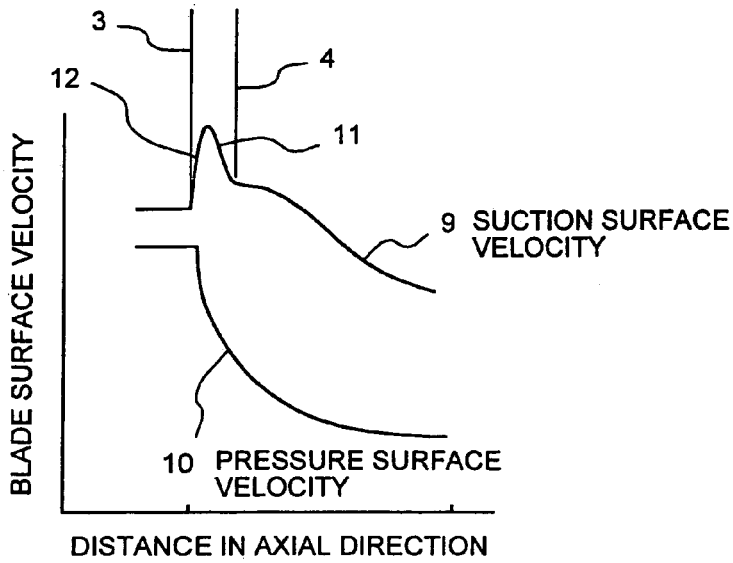
FIG. 10A (Prior Art)
FIG. 10A is a schematic view of the conventional blade surface velocity.
Figure 10B:
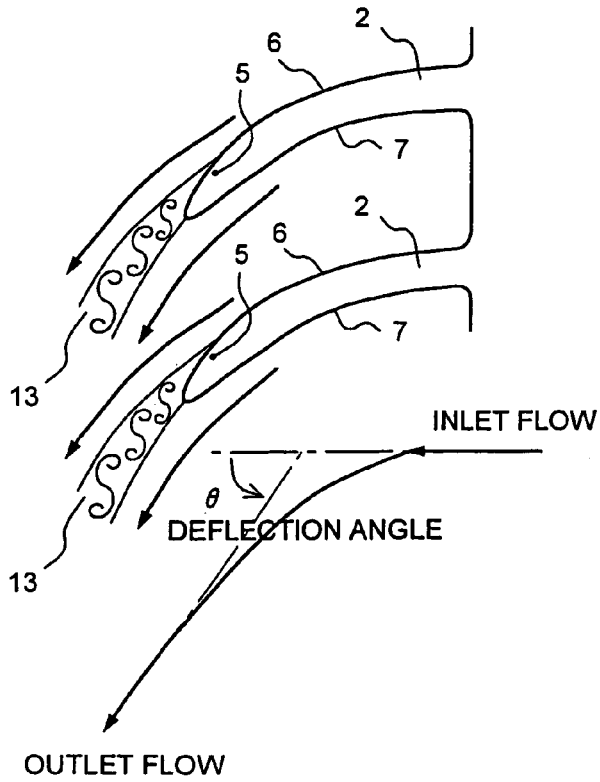
FIG. 10B (Prior Art)
FIG. 10B is a schematic view of a separation state of the flow based on the blade shape.

Since the trailing edge 3 of the rotor blade 2 is formed in the manner mentioned above, a rapid increase of the deflection angle is prevented in the trailing edge portion 5. Accordingly, as shown in FIG. 3A and FIG. 3B, since the rapid ascent portion 11 and the rapid deceleration portion 12 (refer to FIG. 10A and FIG. 10B) in the conventional case do not occur in the suction surface velocity 9 in the main stream, it is possible to prevent the separation of the flow in the trailing edge portion 5. Therefore, it is possible to reduce a loss of flow and improve turbine efficiency.

As described above, according to the turbine rotor blade according to the first embodiment, it is possible to prevent the flow from separating in the trailing edge portion 5 and prevent the loss of flow from being increased. Thus, it is possible to improve the turbine efficiency.

In the first embodiment mentioned above, it is assumed that the trailing edge 3 of the rotor blade 2 is formed so as to be inclined from the center line 8 of the blade thickness toward the extension line 6*a* of the suction surface 6 and thereby the trailing edge 3 is close to the extension line 6*a* in the upstream side of the maximum blade thickness portion 4. However, the structure is not limited to this, and the trailing edge 3 may be formed so as to be positioned on the extension 6*a* of the suction surface 6 in the upstream side of the maximum blade thickness portion 4. In this case, the same effect as that mentioned above can be also expected.

Figure 4A:
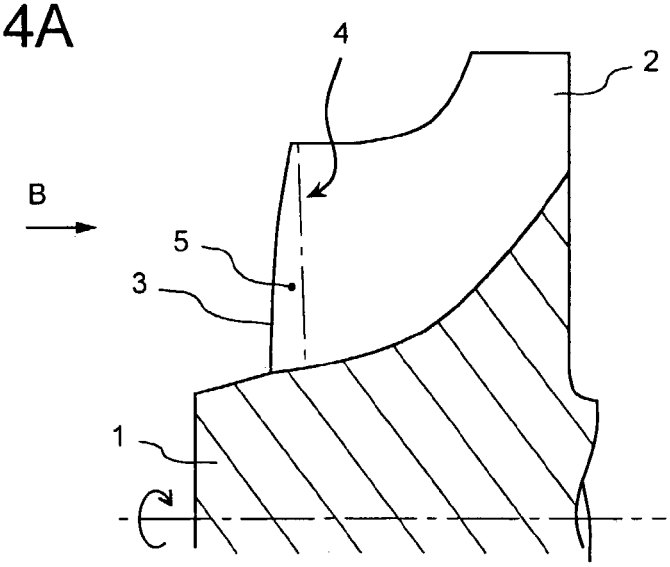
FIG. 4A is a cross sectional view of a turbine rotor blade according to a second embodiment of this invention.
Figure 4B:
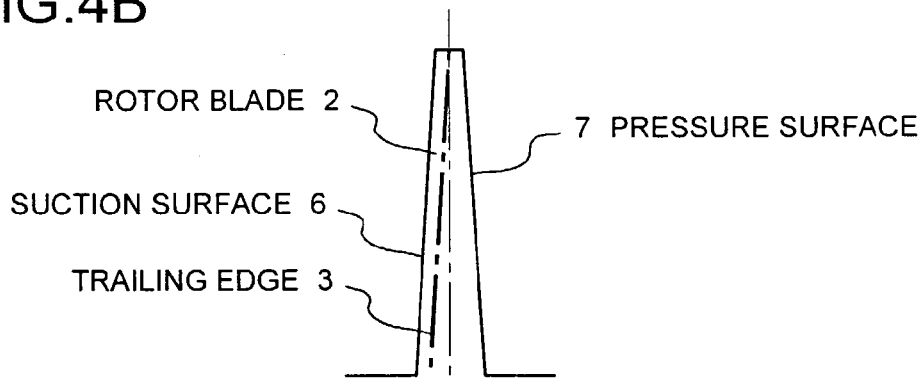
FIG. 4B is a schematic view when viewed from a direction B, that is, a downstream direction in FIG. 4A.
Figure 5:
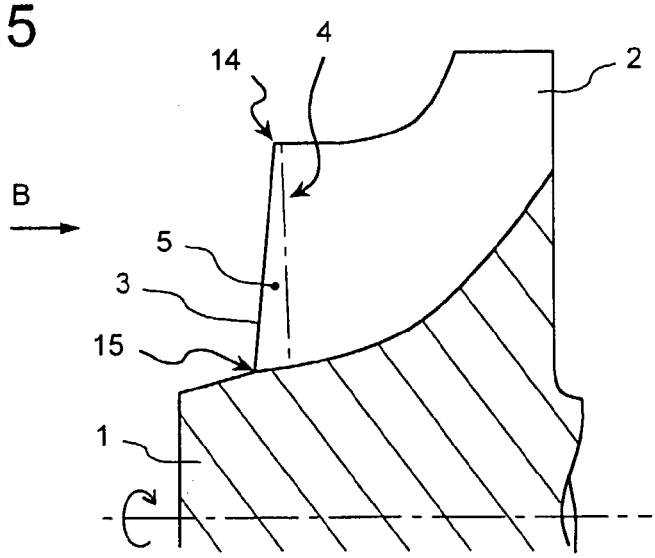
FIG. 5 is a cross sectional view of a turbine rotor blade whose trailing edge is formed in a linear shape.

FIG. 4A is a cross sectional view of a turbine rotor blade according to a second embodiment of this invention, and FIG. 4B is a schematic view when viewed from a direction B, that is, a downstream direction in FIG. 4A. The second embodiment corresponds to an embodiment applied to a rotor blade whose trailing edge is formed in a parabolic shape. FIG. 5 is a cross sectional view of a turbine rotor blade whose trailing edge is formed in a linear shape.

In the first embodiment, the trailing edge 3 of the rotor blade 2 is formed so as to be inclined from the center line 8 of the blade thickness toward the extension line 6*a* of the suction surface 6 and thereby the trailing edge 3 is close to the extension line 6*a* in the upstream side of the maximum blade thickness portion 4. However, according to the second embodiment, a distribution in a blade height direction of the trailing edge 3 is defined. That is, as shown in FIG. 4B, the trailing edge 3 is formed so as to be inclined toward the side of the suction surface 6 and thereby the trailing edge 3 is close to the suction surface 6 over the whole blade height. In this case, the rotor blade. 2 (refer to FIG. 5) whose trailing edge 3 is formed in the linear shape, can be formed in the same manner as mentioned above.

Since the trailing edge 3 is formed in the same manner as mentioned above, the deflection angle in the trailing edge portion 5 is not rapidly increased, and the rapid ascent portion 11 and the rapid deceleration portion 12 occurring in the conventional case do not occur in the suction surface velocity in the main stream, and therefore it is possible to prevent the flow from separating in the trailing edge portion 5. Accordingly, it is possible to reduce the loss of the flow and improve the turbine efficiency.

Figure 6A:
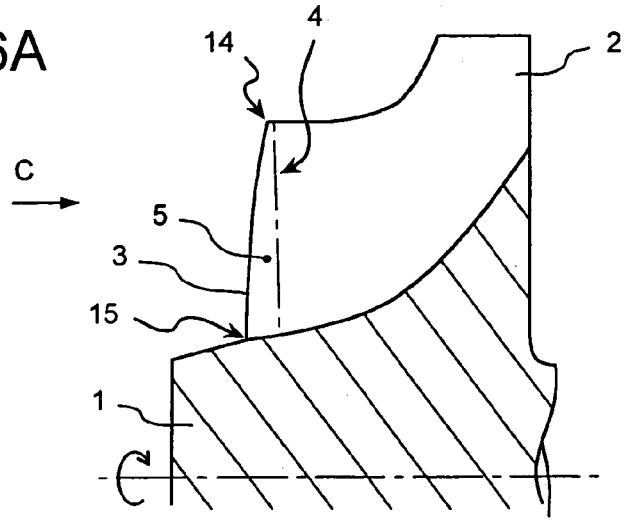
FIG. 6A is a cross sectional view of a turbine rotor blade according to the third embodiment of this invention.
Figure 6B:
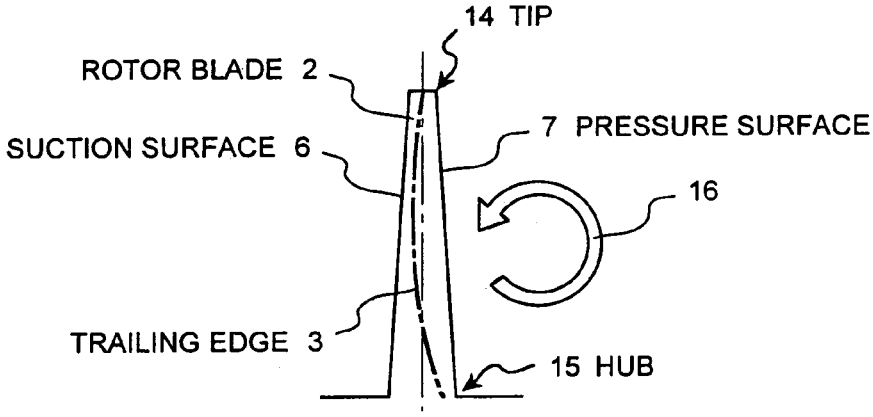
FIG. 6B is a schematic view when viewed from a direction C, that is, a downstream direction in FIG. 6A.
Figure 7:
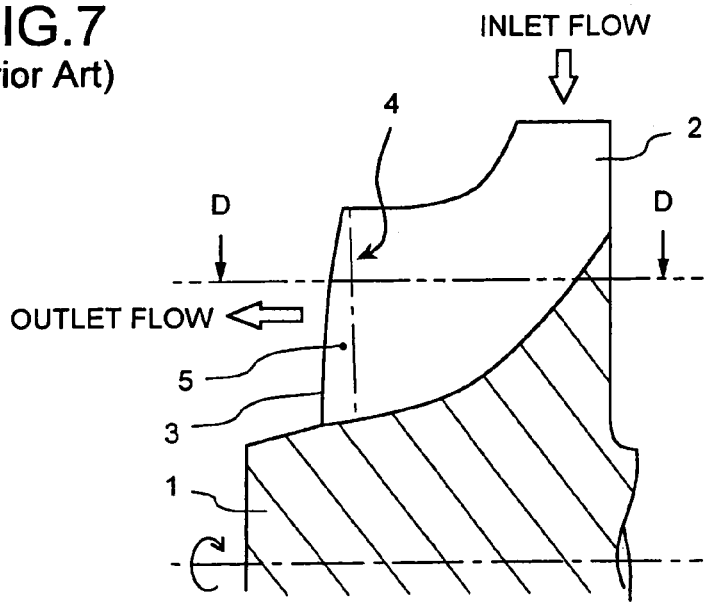
FIG.7 (Prior Art)
FIG. 7 is a cross sectional view of the conventional turbine rotor blade whose trailing edge is formed in a parabolic shape.
Figure 8:
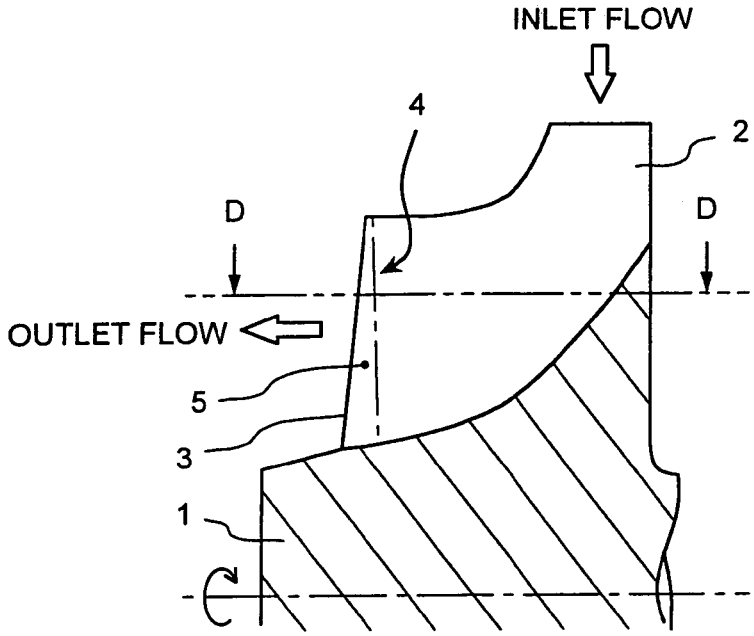
FIG.8 (Prior Art)
FIG. 8 is a cross sectional view of the conventional turbine rotor blade whose trailing edge is formed in a linear shape.
Figure 9B:
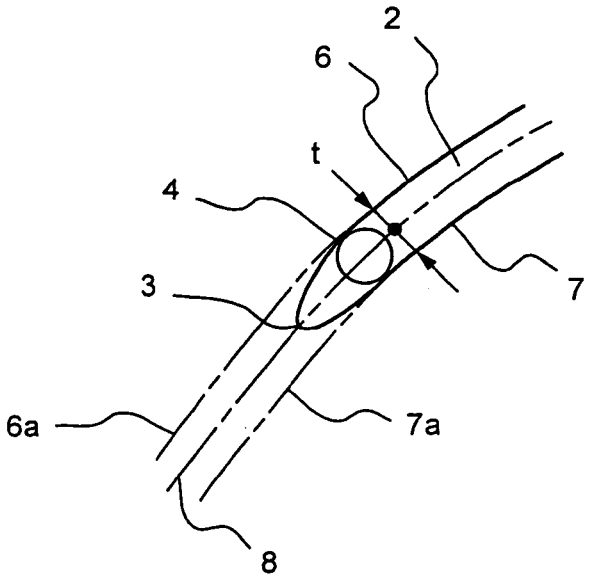
FIG. 9B (Prior Art)
FIG. 9B is a magnified view of a portion indicated in a circle in FIG. 9A.
Figure 9A:
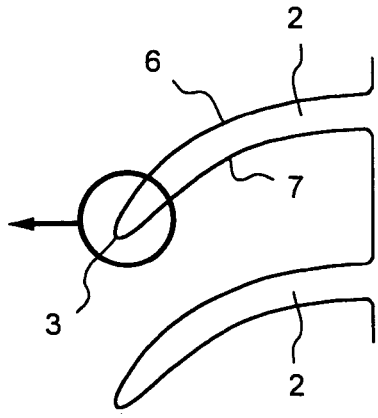
FIG. 9A (Prior Art)
FIG. 9A is a cross sectional view of the rotor blade along a line D—D of the rotor blade shown in FIG. 7 or FIG. 8.

FIG. 6A is a cross sectional view of a turbine rotor blade according to a third embodiment of this invention, and FIG. 6B is a schematic view when viewed from a direction C, that is, a downstream direction in FIG. 6A. The third embodiment is an example applied to a rotor blade whose trailing edge is formed in a parabolic shape.

In the first embodiment, the trailing edge 3 of the rotor blade 2 is formed so as to be inclined from the center line 8 of the blade thickness toward the extension line 6*a* of the suction surface 6 and therefore the trailing edge 3 is close to the extension line 6*a* in the upstream side of the maximum blade thickness portion 4. However, according to the third embodiment, a distribution in a blade height direction of the trailing edge 3 is further defined.

That is, when a longitudinal vortex 16 of the main stream is significant as shown in FIG. 6B, the flow is going to move toward the suction surface 6 in the side of a hub 15. Accordingly, the flow is moving along the suction surface 6 without relation to the deflection angle of the blade shape, and no flow separation occurs in some cases in the side of the hub 15.

The trailing edge 3 of the rotor blade 2 is formed so as to be inclined toward the side of the suction surface 6 and thereby the trailing edge 3 is close to the suction surface 6 in the side of a tip 14, and is formed so as to be inclined toward the side of the pressure surface 7 and thereby the trailing edge 3 is close to the pressure surface 7 in the side of the hub 15. In this case, the rotor blade 2 whose trailing edge 3 is formed in the linear shape (refer to FIG. 5) can also be formed in the same manner as mentioned above.

As described above, according to the turbine rotor blade of the third embodiment, it is possible to effectively control the respective flows in the side of the tip 14 and in the side of the hub 15 when the longitudinal vortex 16 of the main stream is significant, and therefore it is possible to reduce the loss of the flow, thus improving the turbine efficiency.

As described above, according to the turbine rotor blade of this invention, the deflection angle of the blade surface in the downstream side of the maximum blade thickness portion is formed small by forming the trailing edge of the rotor blade so as to position on the extension line of the suction surface in the upstream side of the maximum blade thickness portion, or forming the trailing edge of the rotor blade in the inclined manner toward the extension line from the center line of the blade thickness and thereby the trailing edge is close to the extension line in the turbine rotor blade. Therefore, the rapid increase of the deflection angle is prevented in the trailing edge portion, and the rapid ascent or the rapid deceleration occurring in the conventional case is not generated in the suction surface velocity in the main stream, thus, it is possible to prevent the separation of the flow in the trailing edge portion. Accordingly, it is possible to reduce the loss of flow and improve the turbine efficiency.

Furthermore, the trailing edge of the rotor blade is formed so as to be inclined toward the suction surface side and thereby the trailing edge is close to the suction surface over the whole height of the blade. Therefore, it is possible to prevent the separation of the flow over the whole blade height in the trailing edge portion. Accordingly, it is possible to reduce the loss of flow and improve the turbine efficiency.

Moreover, the trailing edge of the rotor blade is formed so as to be inclined toward the suction surface side and thereby the trailing edge is close to the suction surface in the tip side. The trailing edge is formed so as to be inclined toward the pressure surface side and thereby the trailing edge is close to the pressure surface in the hub side. Therefore, it is possible to-effectively control the flows in the tip side and the hub side, respectively, when the longitudinal vortex of the main stream is significant. Accordingly, it is possible to reduce the loss of flow and improve the turbine efficiency.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A turbine rotor blade for a radial flow turbine or a mixed turbine comprising:

a first portion having a first suction surface and a first pressure surface;

a second portion adjoining the first portion, having a second suction surface and a second pressure surface that are contiguous to the first suction surface and the first pressure surface, respectively;

a leading edge that is arranged in the first portion, and from which an inlet flow enters into the turbine rotor blade from a substantially radial direction of the radial turbine rotor blade or from a direction between a radial direction and an axial direction of the mixed flow turbine rotor blade;

a trailing edge at which the second suction surface and the second pressure surface of the second portion intersect with each other, and from which the flow is blown out in a substantially tangential direction of the turbine rotor blade;

a root end configured to be fixed to a hub; and a tip end opposite to the root end, wherein the root end and the tip end define a height of the turbine rotor blade therebetween, wherein:

the turbine rotor blade has a maximum thickness in the first portion adjacent to a boundary between the first portion and the second portion when viewed along a cross section in a plane perpendicular to a height direction of the turbine rotor blade over at least a part of the height of the turbine rotor blade, an imaginary plane that passes at a half of a distance between the first suction surface and the first pressure surface corresponds to a center line, the first suction surface corresponds to a suction surface line, and the trailing edge is arranged between an imaginary center line extended from a center line and an imaginary extension line extended from the suction surface line, the tip end includes a first tip end at a side where the leading edge exists and a second tip end at a side where the trailing edge exists, and a distance between an axis of the turbine rotor and an intersection of the first tip end and the leading edge is longer than a distance between the axis and the second tip end so that the turbine rotor blade deflects the inlet flow toward the axial direction of the turbine rotor blade on a meridian section, and the flow is blown out at the trailing edge toward the substantially tangential direction of the turbine rotor blade.

2. The turbine rotor blade according to claim 1, wherein the first portion that is from leading edge to the maximum thickness includes a portion of the turbine rotor blade which deflects a flow coming from a relatively radial direction of the turbine rotor blade toward a tangential direction of the turbine rotor blade.

3. The turbine rotor blade according to claim 1, wherein the trailing edge, in a cross section in the plane over an entire height of the turbine rotor blade, is arranged between the imaginary center line and the imaginary extension line.

4. A turbine rotor blade for a radial flow turbine or a mixed turbine comprising:

a first portion having a first suction surface and a first pressure surface;

a second portion adjoining the first portion, having a second suction surface and a second pressure surface that are contiguous to the first suction surface and the first pressure surface, respectively;

a leading edge that is arranged in the first portion, and from which an inlet flow enters into the turbine rotor blade from a substantially radial direction of the radial turbine rotor blade or from a direction between a radial direction and an axial direction of the mixed flow turbine rotor blade;

a trailing edge at which the second suction surface and the second pressure surface of the second portion intersect with each other, and from which the flow is blown out in a substantially tangential direction of the turbine rotor blade;

a root end configured to be fixed to a hub; and a tip end opposite to the root end, wherein the root end and the tip end define a height of the turbine rotor blade therebetween, wherein:

the turbine rotor blade has a maximum thickness in the first portion adjacent to a boundary between the first portion and the second portion when viewed along a cross section in a plane perpendicular to a height direction of the turbine rotor blade over at least a part of the height of the turbine rotor blade, an imaginary plane that passes at a half of a distance between the first suction surface and the first pressure surface corresponds to a center line, the first suction surface corresponds to a suction surface line, and the trailing edge is arranged between an imaginary center line extended from a center line and an imaginary extension line extended from the suction surface line, the tip end includes a first tip end at a side where the leading edge exists and a second tip end at a side where the trailing edge exists, a distance between an axis of the turbine rotor and an intersection of the first tip end and leading edge is longer than a distance between the axis and the second tip so that the turbine rotor blade deflects the inlet flow toward the axial direction of the turbine rotor blade on a meridian section, and the flow is blown out at the trailing edge toward the substantially tangential direction of the turbine rotor blade, and the trailing edge, in cross-section in the plane, is on the imaginary center line at the tip end, and between the imaginary center line and the imaginary extension line at any height of the turbine rotor blade between the tip end and the root end.

5. The turbine rotor blade according to claim 4, wherein the trailing edge has a linear form that extends from a point on the imaginary center line at the tip end and is inclined toward the first suction surface.

6. A turbine rotor blade for a radial flow turbine or a mixed turbine comprising:

a first portion having a first suction surface and a first pressure surface;

a second portion adjoining the first portion, having a second suction surface and a second pressure surface that are contiguous to the first suction surface and the first pressure surface, respectively;

a leading edge that is arranged in the first portion, and from which an inlet flow enters into the turbine rotor blade from a substantially radial direction of the radial turbine rotor blade or from a direction between a radial direction and an axial direction of the mixed flow turbine rotor blade;

a trailing edge at which the second suction surface and the second pressure surface of the second portion intersect with each other, and from which the flow is blown out in a substantially tangential direction of the turbine rotor blade;

a root end configured to be fixed to a hub; and a tip end opposite to the root end, wherein the root end and the tip end define a height of the turbine rotor blade therebetween, wherein:

the turbine rotor blade has a maximum thickness in the first portion adjacent to a boundary between the first portion and the second portion when viewed along a cross section in a plane perpendicular to a height direction of the turbine rotor blade over at least a part of the height of the turbine rotor blade, an imaginary plane that passes at a half of a distance between the first suction surface and the first pressure surface corresponds to a center line, the first suction surface corresponds to a suction surface line, and the trailing edge is arranged between an imaginary center line extended from a center line and an imaginary extension line extended from the suction surface line, the tip end includes a first tip end at a side where the leading edge exists and a second tip end at a side where the trailing edge exists, a distance between an axis of the turbine rotor and an intersection of the first tip end and leading edge is longer than a distance between the axis and the second tip so that the turbine rotor blade deflects the inlet flow toward the axial direction of the turbine rotor blade on a meridian section, and the flow is blown out at the trailing edge toward the substantially tangential direction of the turbine rotor blade, and the trailing edge, in a cross section in the plane, is on the imaginary center line at the tip end, and the trailing edge is convex toward the suction surface between the tip end and the root end.

7. The turbine rotor blade according to claim 6, wherein the trailing edge, in a cross section in the plane, crosses the imaginary center line at a predetermined height from the root end.

* * * * *